US008196274B2

(12) United States Patent
Heckenbach

(10) Patent No.: US 8,196,274 B2
(45) Date of Patent: Jun. 12, 2012

(54) URNS IN THE SHAPE OF SPORTS ARTICLES

(75) Inventor: Ralf Heckenbach, Corpus Christi, TX (US)

(73) Assignee: Bavarian Investment Group, LLC, Corpus Christi, TX (US)

( * ) Notice: Subject to any disclaimer, the term of this patent is extended or adjusted under 35 U.S.C. 154(b) by 36 days.

(21) Appl. No.: 12/456,170

(22) Filed: Jun. 12, 2009

(65) Prior Publication Data

US 2010/0313395 A1 Dec. 16, 2010

(51) Int. Cl.
*A61G 17/00* (2006.01)

(52) U.S. Cl. ..... 27/1

(58) Field of Classification Search ..... 27/35; D99/5; 211/85.27; 220/504, 507, 524, 532, 553
See application file for complete search history.

(56) References Cited

U.S. PATENT DOCUMENTS 4,521,999 A * 6/1985 Flanagan ..... 52/103
D304,641 S * 11/1989 Bourassa ..... D99/5
5,832,575 A * 11/1998 Sturino ..... 27/1
5,896,632 A * 4/1999 Sturino ..... 27/1
D485,660 S * 1/2004 Mocellin ..... D99/5
6,944,921 B1 * 9/2005 Gersten ..... 27/1
7,036,195 B2 * 5/2006 Glass ..... 27/1
D524,510 S * 7/2006 Adams ..... D99/5
7,406,754 B2 * 8/2008 Trail ..... 27/1
D584,475 S * 1/2009 Mytych et al. ..... D99/5
7,475,457 B1 * 1/2009 Gersten ..... 27/1
D612,572 S * 3/2010 Doty ..... D99/5
2010/0199476 A1 * 8/2010 Cummings et al. ..... 27/1

* cited by examiner

*Primary Examiner* — William L. Miller
(74) *Attorney, Agent, or Firm* — M. Susan Ochoa Spiering

(57) ABSTRACT

Disclosed is a single unit crematory urn in the shape of a sports article wherein cremated remains of humans or pets are disposed within the sports shaped article. The article can be, for example, in the shape of a basketball, football, baseball, baseball bat, baseball glove, hockey puck, hockey stick, bowling ball, bowling pin, and the like. Any sports article having a hollow center is suitable for this invention. A base is optionally utilized to secure the bottom of the sports shaped article and retain in an upright position. The article is a replica constructed out of substantially rigid polymeric material. The article may optionally be covered with a clear case to protect from the environment. The single unit has an opening, and removable closure, to allow the cremated remains to be placed therewithin. The unit may be constructed for holding the cremated remains of one or more human or pets.

22 Claims, 3 Drawing Sheets

URNS IN THE SHAPE OF SPORTS ARTICLES

BACKGROUND OF INVENTION

1. Field of the Invention

The present invention relates generally to funeral products, and more particularly, to cremation containers in the shape of sports articles, for memorializing one whose cremated remains are contained therein.

2. Background Art

Cremation of the mortal remains of living creatures, such as humans and pets, has become increasingly popular. The popularity of cremation is due to the fact that it is less expensive than being interred into the ground, and it may avoid storage charges if the remains are located within the individual's residence if not stored at some exterior location, such as in a mortuary. The end product of the cremation process, after removal of non-combustible materials and grinding, is a small volume of finely ground ash.

Disposal of this ash has taken many forms. One form would be to dispose of the ash into a sea, ocean, lake, or on land in a particular location. In such an instance, there is no need for a burial urn. However, some people choose to retain some or all of the cremated remains as constituting a memory of the loved one that has been lost.

Upon the death of a loved one, human or pet, it is often desired to memorialize the deceased's life in some personal manner. Even where the deceased ashes are scattered, it is often desired to retain and display the scattering container, for example, on a fireplace mantel, coffee table, end table or the like, as a means for memorializing a loved one.

Cremation urns are well known and have been described for instance in U.S. Pat. No. 2,009,724, dated Jul. 30, 1935, as invented by BIRCHER, for a receptacle comprising 2 parts having abutting edges, the edges being grooved to receive a sealing strip.

Today, there remains a demand for more styles and designs of cremation containers. One popular design theme for cremation urns is the outdoor or animal theme, considering that one of the most common places for scattering ashes is the backyard or garden. In this regard, there have been proposed various attractive means for displaying cremation containers.

Typically, burial urns take the form of a vase, box, birdhouse, or a similar type of container where the cremated remains of the lost loved one are to be placed.

For example, U.S. Pat. No. 5,029,373 to Raymond discloses a cremation container in the form of a flower vase. The container has a first compartment for storing the ashes of a deceased and a separate second compartment for holding and displaying flowers.

U.S. Pat. No. 6,175,995 to Parker et al. and U.S. Pat. No. D444,933 to Parker show various cremation containers in the forms of lawn and garden ornaments. Specifically, these patents show decorative structures such as sun dials, planters, wind chimes and bird baths that all have an inner compartment for maintaining and securing the ashes of a deceased in a permanent manner. U.S. Pat. No. 7,272,874 discloses birdhouses to be used as cremation urns. U.S. Pat. No. 6,763,558 discloses vehicle shaped caskets and urns. However, for the sports enthusiasts, a cremation container in the form of a sports article from a favorite sport is desirable.

Heiso Corporation in Germany has been selling metal steel urns, one of which is in the shape of a soccer ball. No other sports shaped articles are displayed. The steel is heavy, subject to corrosion and ill effects of the elements, and relatively expensive, at least compared to lighter weight plastic as an alternative material. In addition, the ball shaped urn article is separate from the base provided.

In The Light Urns is an online company selling sports shaped urns where an actual sports article is utilized and displayed under a clear case. Ashes or cremated remains are stored in a separate wooden base.

It has been heretofore unknown to provide a cremation container in the form of a sports article such as a basketball, baseball, or related items (e.g., bat, glove, etc.), hockey puck, football, or the like which is constructed in a cost effective manner, from long lasting lightweight material, and wherein the cremated remains are stored in the sports article itself. Accordingly, it would be desirable to provide an alternative means of memorializing a loved one with a history as a sports enthusiast to what has previously been available.

SUMMARY OF INVENTION

In summary, the present invention discloses sports shaped articles for use as urns to hold the cremated remains of human or pet loved ones. The urns of the present invention are stylized funeral containers that are configured to reflect the particular choice of the deceased's favorite sport. The sports shaped articles or funeral containers include a body portion, a lid or open portion and a mounting base member, all as one piece. The ashes are held in the sports shaped article or body portion. An opening with a lid, or optionally a removable closure, can be placed in the base or the sports shaped article for inserting the cremated remains. The mounting base portion is positioned underneath the sports shaped article to provide support for the article itself.

Optionally, an interior body retaining compartment is located inside of the sports shaped article. As a further feature, the interior may have separate compartments, and be filled through two access openings, each opening to a discrete individual compartment. This is so that remains of two individuals may be kept in one urn. Separate compartments in the interior allow for the remains of the separate individuals to not be disturbed when the remains of a second individual is added to the urn.

If desired, the article can be covered with a clear or colored case to protect the article and cremated remains therein. The cover case can be attached to the base or it may just lie on top of the base, covering the sports shaped article. If attached thereto, the cover case may pivot openly about a plurality of hinges that connect the case to the base.

Another feature of the present invention is to have a faceplate on the base or the cover case identifying the deceased. Another related feature is to display a sports emblem from, for example, a favorite sports team of the deceased. The identification members contain features that are particular to the deceased and their interests.

Accordingly, it is a principal object of the invention to provide urns that are designed to reflect sports oriented culture and interest of the deceased.

It is another object of the invention to provide urns that feature the lines, curves and recognizable styling of specific sports articles.

Further embodiments and features will be apparent from the description which follows.

DETAILED DESCRIPTION

The present invention discloses a single unit, non metal, crematory urn comprising a sports shaped article having a hollow center adapted for receiving and retaining cremated remains of at least one individual or pet, containing optionally, a base attached to the article for support of the article, and an aperture, or opening, wherein the cremated remains are inserted. By single unit, it is meant that the entire unit is one piece. The remains are typically held in the sports shaped article, but may be placed in the base portion of the unit. The urn may be constructed of any substantially rigid thermoplastic resin or polymeric material suitable for making rigid, molded products. Preferably, the material is selected from the group of acrylonitrile butadiene styrene (ABS), polyacetal, polycarbonate, polyethylene (PE), polyethylene terephthalate (PET), polyethylene terephthalate ester (PETE), polyphenylene ether (PPE), polyvinyl chloride (PVC), polypropylene (PP), polyetherimide (PEI), and melamine formaldehyde, with polyethylene being most preferred based on cost and ease of use in manufacturing. The polymeric resins can be blended, and are chosen based on various factors such as cost, handling, toxicity, and environmental effects. Generally, the urn has at least one aperture found in the sports shaped article of the unit, but the aperture may also be placed on the base portion of the unit. For example, if a basketball shape is desired, the aperture for inserting the cremated remains may be on the bottom, back or top section of the ball. The aperture may have a removable closure, or be placed with a hinge-type mechanism for opening and closing of the closure element. The closure may also be a screw-type or rubber plug in type closure. Generally, any closure which ensures a secure closing of the aperture may be used. The closure further may have a locking or sealing type mechanism for safe keeping of the remains. The aperture and closure are of a suitable size for ease in inserting the remains therein. An example of a suitable size is approximately 2.5×2.5 inches.

Figure 1:
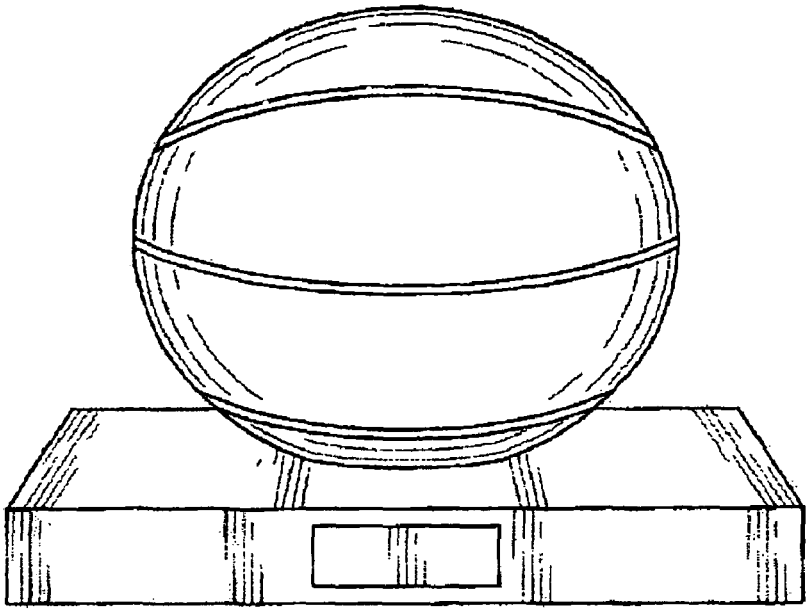
FIG. 1 is a view of a crematory urn in the shape of a basketball on a base.
Figure 2:
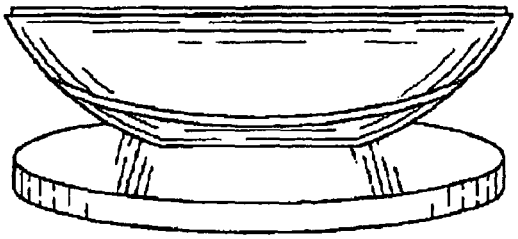
FIG. 2 is a partial view of the basketball positioned on a narrower type of base.
Figure 3:
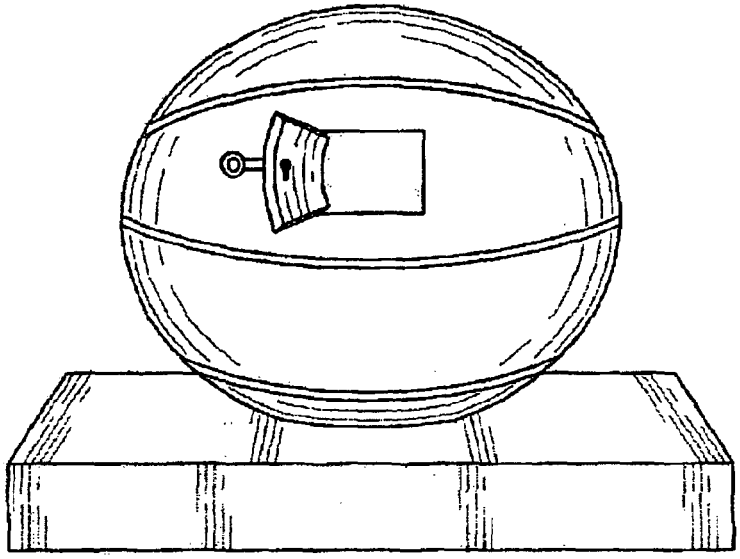
FIG. 3 is a view of the back of the basketball and base unit wherein the aperture is placed on the back of the unit, and is shown having a lockable, hinge-type closure.
Figure 4:
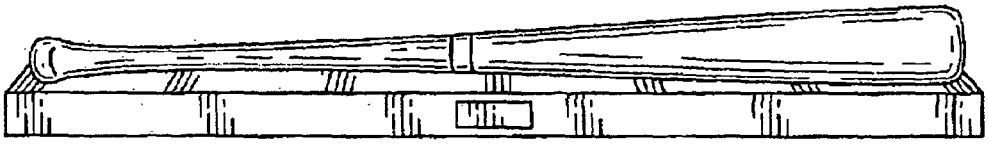
FIG. 4 is a view of a baseball bat on a representative base.

Various shapes of the unit may be utilized and the present examples are intended for illustrative and non limiting purposes. For example, the single, non metal unit may take, the shape of a basketball, a baseball, a baseball glove, a baseball bat, a soccer ball, a hockey puck, a hockey stick, a football, a golf ball, a golf club, tennis racket and tennis ball, bowling ball and bowling pin, boxing glove, or a volleyball. Other athletic or sports shaped articles may be used, provided there is a hollow center for potential storage of the cremated remains. Referring to the figures, FIG. 1 is a view of a crematory urn in the shape of a basketball on a base. FIG. 2 is a partial view of the basketball positioned on a narrower type of base. FIG. 3 is a view of the back of the basketball and base unit wherein the aperture is placed on the back of the unit, and is shown having a lockable, hinge-type closure. FIG. 4 is a view of a baseball bat on a representative base.

The urn or unit may also have at least one faceplate to identify the remains contained therein. It may also have at least one sports emblem indicating a favorite sports team of the deceased.

Optionally, the unit may have a clear or colored covering case over the sports shaped article resting on the base thereof. A case will allow for protection from the environment. Within the cover there may further be features to secure the sports shaped article and not allow it to move in the event of relocating the urn to another location, or a type of natural disaster (such as an earthquake, hurricane, or tornado) which may cause movement and possible breakage of the urn.

While the ashes or cremated remains of one individual human or pet may be housed in the unit, it is possible to have more than one housed within the same unit. The hollow center of the sports shaped article may have partitions for housing numerous remains of members. Alternatively, the base may have partitions for same. Each partition will have its respective aperture for inserting the cremated remains. Depending on the rigidity of the polymeric resin employed, if the hollow center is partitioned for holding cremated remains of more than one individual or pet, it may need to be adapted and supported internally with walls or the like, for the partition.

Figure 5:
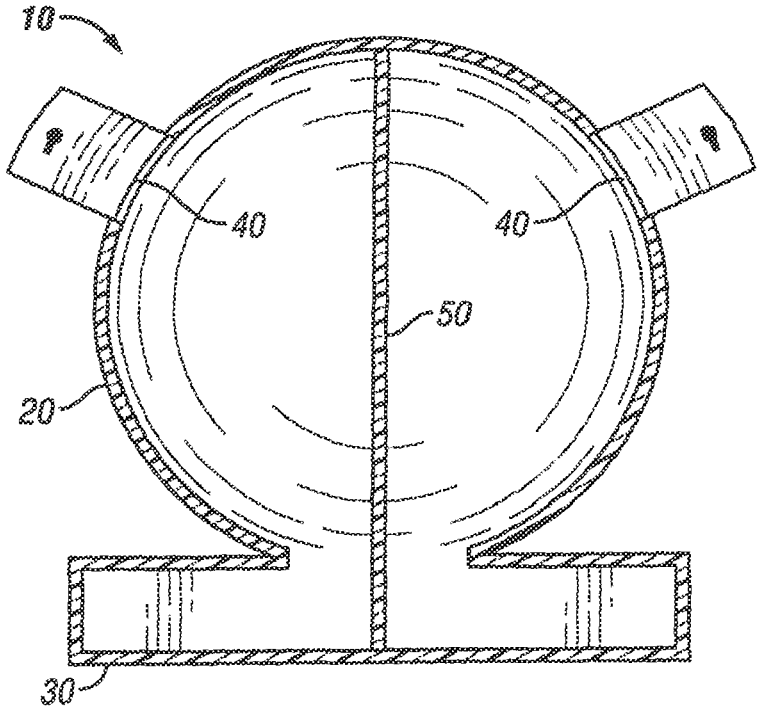
FIG. 5 is a sectional view of the basketball and base unit of FIG. 3, showing a partition within the basketball and the base.
Figure 6:
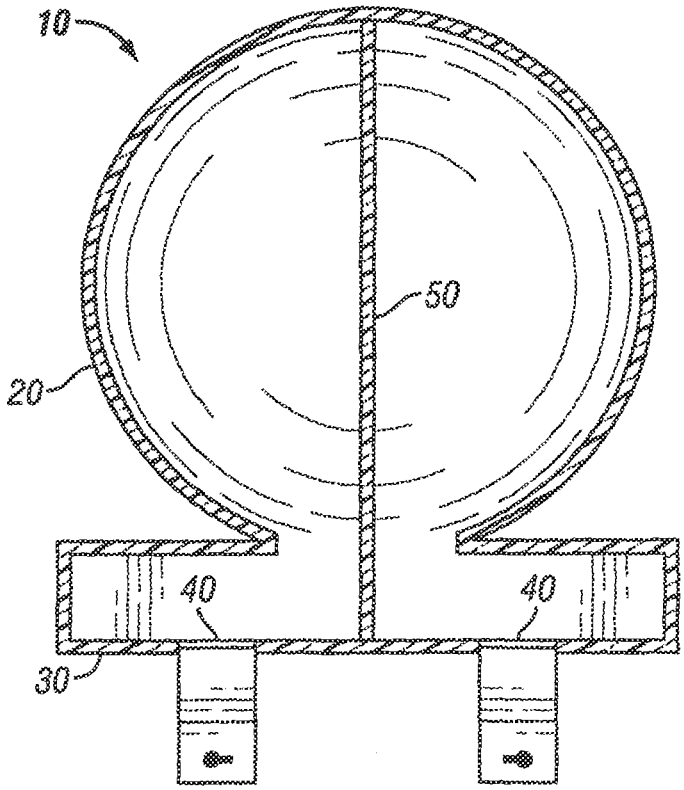
FIG. 6 is a sectional view of the basketball and the base unit of FIG. 3, presenting an alternative embodiment to FIG. 5, in which apertures are found on the base.

A partitioned unit is illustrated in FIG. 5. Unit 10, comprising sports shaped article 20, base 30 and aperture 40 is shown with section removed. Unit 10 has a partition 50 within the hollow center of article 20 and the base 30. An alternative embodiment is shown in FIG. 6, in which apertures 40 are present on the base 30.

The main advantage of the present invention, over that found presently in the art, is that a cremation container is provided which provides a loved one of a deceased an alternative, somewhat nontraditional yet nonetheless attractive, means of displaying the cremated remains of the deceased. A one unit system is simpler than a multiple unit system wherein parts can fall off and/or break. The polymeric material employed allows for longevity, and is more cost effective compared to metallic materials which are currently available. Additionally, a polymeric structure eliminates corrosion concerns often associated with metal urn containers.

While the discussion herein has focused on non metal, one piece urn units, it is possible to create the unit from a metallic material which is resistant to the effects of natural elements such as rust and corrosion. For example, the one piece invention can be constructed from an effectively moldable metal such as aluminum, hastelloy, stainless steel, copper, and the like.

Another alternate embodiment of the present invention involves creation of a sports shaped urn without a base, wherein the sports shaped article has a relatively flat bottom portion to secure or lay to a flat surface, such as a chimney mantle, shelf, or the like.

Furthermore, while the present invention involves displaying the urn in public, it could also be used as a burial container. While metal may not be suitable for in-ground burial due to corrosion or rust concerns, a rigid, plastic urn, with or without a base, would be suitable for below ground burial thereof.

It should be understood, of course, that the foregoing relates to preferred embodiments of the invention and that modifications may be made without departing from the spirit and scope of the invention as set forth in the following claims.

What is claimed is:

1. A single unit, crematory urn, comprising:

a. a hollow body defining an interior chamber, said hollow body being formed of a substantially rigid, non-metal material;

b. a base integral to the hollow body; and, c. at least one partition positioned within said interior chamber so as to divide the interior chamber into at least two portions of substantially equal volume, each portion adapted for housing cremated remains of at least one individual human or pet, said partition being formed of a substantially rigid material, and said partition being secured to a side wall and a top wall of said hollow body;

wherein the base contains a hollow interior chamber and the at least one partition extends into the base such that the base has at least two partitioned areas therein, each area being in communication with a respective said portion of said interior chamber of said hollow body, and each area adapted for housing the cremated remains of at least one individual human or pet; and wherein further each partitioned area in the base has at least one opening thereby providing access to the partitioned area of the base and to the respective portion of the interior chamber of said hollow body, each opening adapted to receive a closure member.

2. A single unit, crematory urn, comprising:

a. a hollow body defining an interior chamber, said hollow body being formed of a substantially rigid, non-metal material;

b. a base integral to the hollow body; and c. at least one partition positioned within said interior chamber so as to divide the interior chamber into at least two portions of substantially equal volume, each portion adapted for housing cremated remains of at least one individual human or pet, said partition being formed of a substantially rigid material, and said partition being secured to a side wall and a top wall of said hollow body;

wherein said hollow body has at least two openings for access to said interior chamber such that each portion of the interior chamber is accessible via one of the at least two openings, each opening adapted to receive a closure member;

wherein the base contains a hollow interior chamber and the at least one partition extends into the base such that the base has at least two partitioned areas therein which are in communication with a respective said portion of said interior chamber of said hollow body, each partitioned area adapted for housing the cremated remains of at least one individual human or pet.

3. The urn of claim 2 constructed of a substantially rigid polymeric material.

4. The urn of claim 3 wherein the polymeric material is selected from the group of ABS, polyacetal, polycarbonate, polyethylene, PET, PETE, PPE, PVC, polypropylene, polyetherimide, and melamine formaldehyde.

5. The urn of claim 3 wherein the polymeric material is polyethylene.

6. The urn of claim 2 in the shape of a basketball.

7. The urn of claim 2 in the shape of a baseball.

8. The urn of claim 2 in the shape of a baseball glove.

9. The urn of claim 2 in the shape of a baseball bat.

10. The urn of claim 2 in the shape of a soccer ball.

11. The urn of claim 2 in the shape of a hockey puck.

12. The urn of claim 2 in the shape of a hockey stick.

13. The urn of claim 2 in the shape of a football.

14. The urn of claim 2 in the shape of a golf ball.

15. The urn of claim 2 in the shape of a golf club.

16. The urn of claim 2 in the shape of a volleyball.

17. The urn of claim 2 in the shape of a boxing glove.

18. The urn of claim 2 in the shape of a tennis racket.

19. The urn of claim 2 in the shape of a tennis ball.

20. The urn of claim 2 in the shape of a bowling ball.

21. The urn of claim 2 in the shape of a bowling pin.

22. The urn of claim 2 having at least one sports emblem indicating a sports team.

* * * * *